US006875128B2

(12) United States Patent
Bonneau

(10) Patent No.: US 6,875,128 B2
(45) Date of Patent: Apr. 5, 2005

(54) GOLF PUTTER HEAD

(76) Inventor: Michael D. Bonneau, 5831 Algonquin Way, San Jose, CA (US) 95138

( * ) Notice: Subject to any disclaimer, the term of this patent is extended or adjusted under 35 U.S.C. 154(b) by 59 days.

(21) Appl. No.: 10/355,771

(22) Filed: Jan. 30, 2003

(65) Prior Publication Data

US 2004/0152538 A1 Aug. 5, 2004

(51) Int. Cl.[7] ..... A63B 53/04
(52) U.S. Cl. ..... 473/340; 473/328
(58) Field of Search ..... 473/324, 328, 473/340, 341, 349; D21/736

(56) References Cited

U.S. PATENT DOCUMENTS

| | | | | | |
|---|---|---|---|---|---|
| RE19,178 | E | | 5/1934 | Spiker | |
| 4,650,191 | A | | 3/1987 | Mills | |
| 4,795,157 | A | | 1/1989 | Bencriscutto | |
| 4,824,115 | A | | 4/1989 | Walther | |
| 4,999,000 | A | | 3/1991 | Finney | |
| 5,211,401 | A | | 5/1993 | Hainey | |
| 5,246,231 | A | | 9/1993 | Antonious | |
| 5,248,145 | A | | 9/1993 | Brown | |
| 5,340,104 | A | | 8/1994 | Griffin | |
| 5,344,149 | A | | 9/1994 | Miller | |
| 5,464,215 | A | | 11/1995 | Koehler | |
| 5,467,987 | A | * | 11/1995 | Perkins et al. | 473/340 |
| 5,643,100 | A | * | 7/1997 | Zabytko et al. | 473/250 |
| 5,655,976 | A | | 8/1997 | Rife | |
| 5,769,738 | A | * | 6/1998 | Kershaw et al. | 473/340 |
| 5,782,706 | A | | 7/1998 | DePriest | |
| 5,857,922 | A | | 1/1999 | Delio | |
| 6,102,814 | A | * | 8/2000 | Grace et al. | 473/340 |
| 6,213,890 | B1 | | 4/2001 | Prince | |
| 6,379,259 | B1 | * | 4/2002 | Opie | 473/251 |
| 6,383,089 | B1 | | 5/2002 | Bonneau | |
| 6,461,250 | B1 | * | 10/2002 | Klyve | 473/329 |
| 6,497,628 | B1 | * | 12/2002 | Gunderson | 473/313 |
| 6,520,865 | B1 | * | 2/2003 | Fioretti | 473/251 |
| 6,579,194 | B1 | * | 6/2003 | Curry | 473/328 |
| 2002/0151376 | A1 | * | 10/2002 | Verne | 473/314 |
| 2002/0165042 | A1 | * | 11/2002 | Wu | 473/340 |
| 2003/0100380 | A1 | * | 5/2003 | D'Eath | 473/340 |
| 2004/0029647 | A1 | * | 2/2004 | Bennett | 473/334 |

* cited by examiner

*Primary Examiner*—Raleigh W. Chiu
(74) *Attorney, Agent, or Firm*—Schneck & Schneck; Thomas Schneck; Gina McCarthy

(57) ABSTRACT

A putter head fashioned from a block metal and having a mass relieved lowermost sole with a flat central surface and upwardly angled surfaces on either side of the flat central surface. The flat central surface is transverse to a front face of the club designed for contacting a golf ball. A top surface of the club, opposite the sole, extends further than the lower sole, which can be thin. The forward dimension of the sole of the club may be reduced to only a few millimeters in thickness, while the top surface of the club remains the same, or the sole may be cantilevered rearwardly, with a tongue-like projection.

19 Claims, 4 Drawing Sheets

GOLF PUTTER HEAD

FIELD OF THE INVENTION

The invention relates to the field of golf clubs and more particularly to golf putters.

BACKGROUND OF THE INVENTION

Successful putting requires precision in addressing a golf ball with a golf club. Small changes in the structure or alignment of the club with regard to the ball or the ground can result in large differences in the flight or path that the ball travels upon putting.

In the design of putters, weight distribution is important in allowing the putter to achieve a successful put. Mass relief putters are known in the art. For example, U.S. Pat. No. 6,383,089, assigned to the assignee of the present invention, describes a putter having an inverted mass relief profile. The putter head is fashioned from a block metal having a conventional face, but having a mass relieved portion behind the face, with the greatest mass relief at the sole of the club and a lesser amount of mass relief extending upwardly to the top surface of the club.

In addition to mass relief, other aspects of the putter assist the user in addressing the ball. For instance, U.S. Pat. No. 5,248,145 to Brown describes a golf club having a top surface inscribed with indicia for aiding the holder in the positioning of a club relative to a golf ball to be struck.

Additionally, Re. 19,178 to Spiker describes a top surface of a golf club formed with a longitudinal groove including prominent fields for sighting means or indicia.

Though the prior art provides mechanisms that enable a golfer to put with improved accuracy and greater control, additional mechanisms to improve a golfer's accuracy and control are also desired.

SUMMARY OF THE INVENTION

The above objects, as well as others, have been achieved with a new putter head design having a mass relieved lowermost region, termed a "sole", with a flat central surface and upwardly angled surfaces on either side of the flat central surface, like angled wings. A top surface of the club extends further than the lower sole, which can be thin. The central flat surface of the sole is, for example, about 2 cm long while the upwardly angled surfaces are, for example, about 3 cm long. The forward dimension of the sole of the club may be reduced to only a few millimeters in thickness, for example between 1–10 mm, while the top surface of the club remains the same, or the sole may have a portion cantilevered rearwardly, with a tongue-like projection.

Mass relief of the club head is achieved by milling regions behind the face of the club and below the top surface, as described in U.S. Pat. No. 6,383,089. Because most of the club head mass is removed toward the bottom of the head, the club design has inverted mass relief in contrast to most clubs of the prior art where mass relief was mainly at the top of the head.

The putter head of the present invention assists the user in properly addressing the ball and in adjusting the club stance relative to the ball. The user is aware that the flat central surface of the club is parallel or substantially parallel with respect to the ground when the flat central surface of the club touches a ground surface such that the club is resting on the flat surface and thus, does not pivot. Before putting, the user lifts the club and maintains the parallel positioning, achieving a proper putting stance. The tongue-like projection also assists the user in maintaining the club in the parallel position with respect to the ground while putting.

Additionally, the smaller size of the sole, due to the mass relief, reduces the amount of resonance of the club that the user typically experiences in his hands when the club makes contact with the ball. Thus, the mass relieved lower sole region, results in more control and less vibration during putting compared to the putters of the prior art, such as those having a curved sole.

DETAILED DESCRIPTION OF THE DRAWINGS

DETAILED DESCRIPTION OF THE INVENTION

Figure 1:
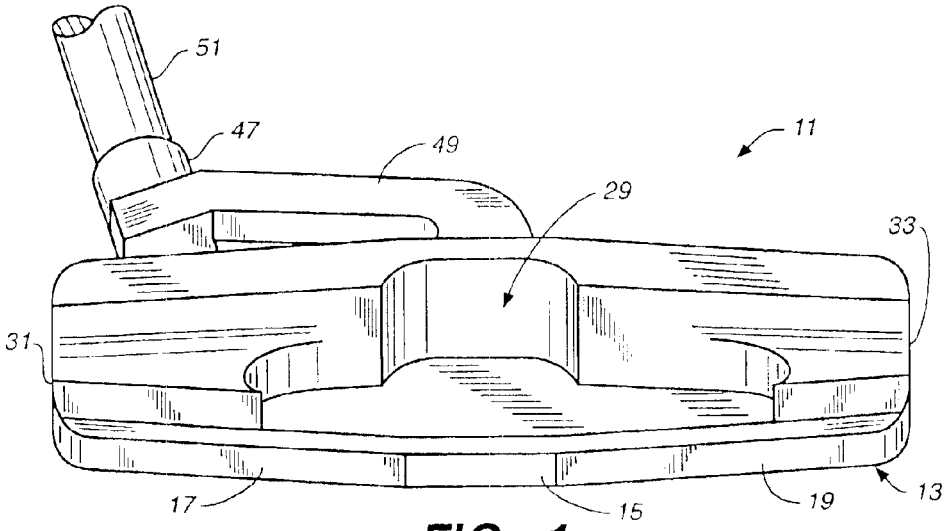
FIG. 1 is a perspective rear view of the putter head of the present invention having a mast relieved lowermost sole.
Figure 2:
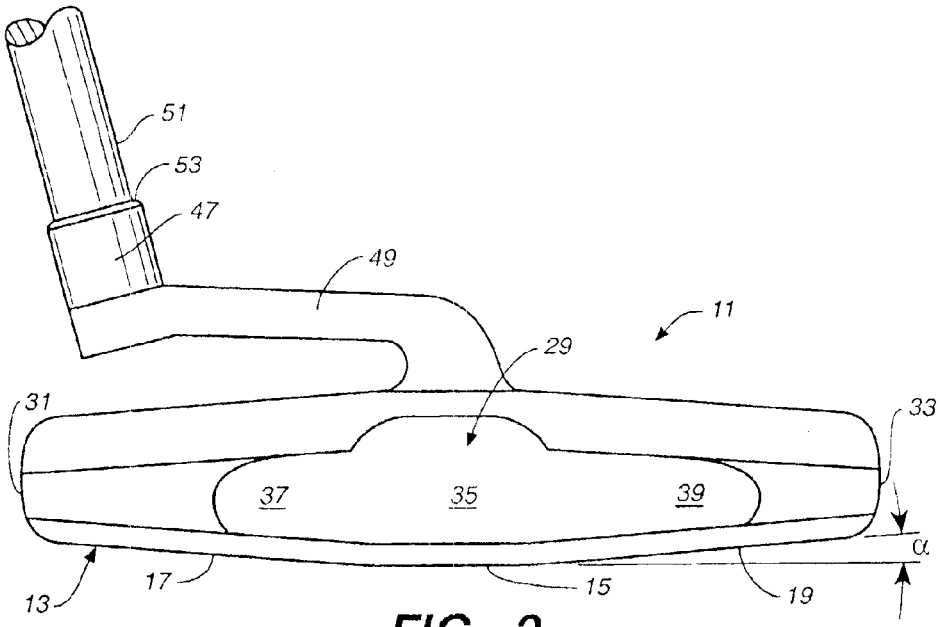
FIG. 2 is a rear view of the apparatus of FIG. 1.
Figure 3:
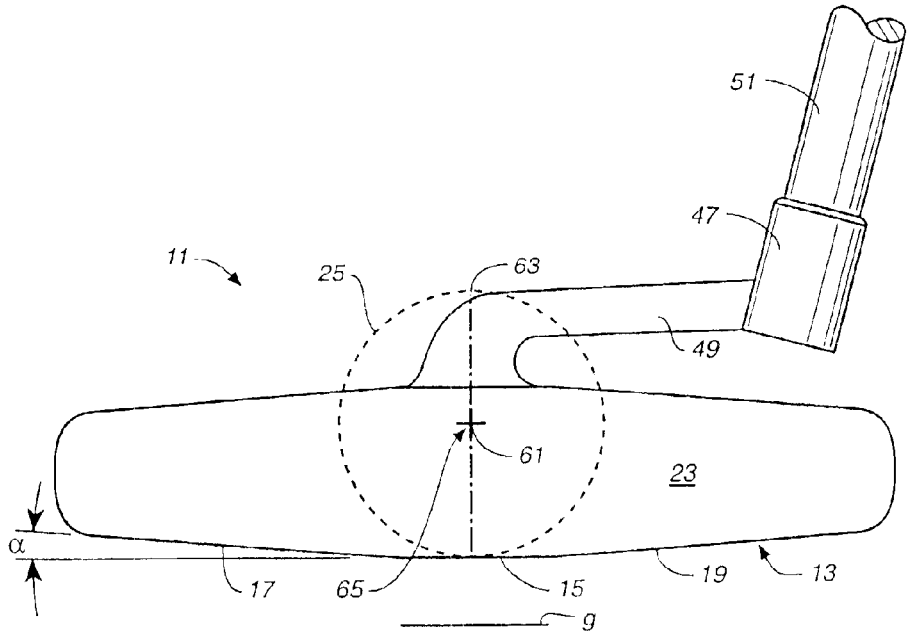
FIG. 3 is a front view of the apparatus of FIG. 1 in a position striking a golf ball.
Figure 4:
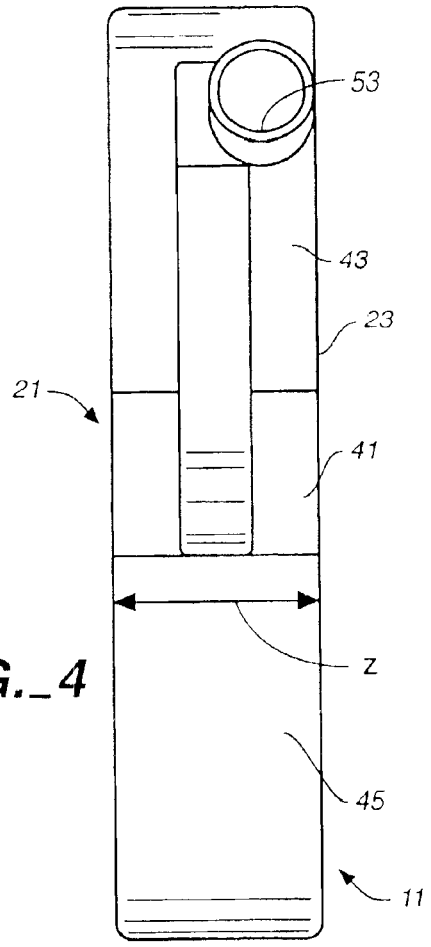
FIG. 4 is a top view of the apparatus of FIG. 1 with a shaft removed.

With reference to FIGS. 1–4, a club or putter head 11 having a mass relieved lowermost region 13, termed a "sole" comprising a lower sole surface including a flat central surface 15 and upwardly angled surfaces 17 and 19 on either side of the flat central surface, like angled wings, is seen. A top surface of the club 21 (FIG. 4), opposite the sole 13, extends further than the lower sole 13, which can be thin. The sole 13 at the bottom of the club 11 is quite thin, unlike the top surface 21 (FIG. 4), which is indistinguishable from the top surface of most putters. The central flat surface 15 of the sole is, for example, about 2 cm long while the upwardly angled surfaces 17 and 19 are, for example, about 3 cm in length. The angled surfaces 17 and 19 may be angled at about 15 degrees with respect to the flat surface central surface 15 as indicated by $\alpha$ (FIGS. 2 and 3). The forward dimension y (FIG. 7) of the sole 13 of the club 11 may be reduced to only a few millimeters in thickness, for example between 1–10 mm, while the forward dimension z of the top surface 21 of club 11 remains the same (FIG. 4).

The sole 13 of the present invention, due to the mass relief, reduces the amount of resonance of the club 11 that the user typically experiences in his hands when the club 11 makes contact with a golf ball. Thus, the sole 13 of the club 11, results in more control and less vibration during putting compared to the putters of the prior art, such as those having a curved sole, and also results in less of a likelihood of the user breaking a wrist position during putting.

Figure 7:
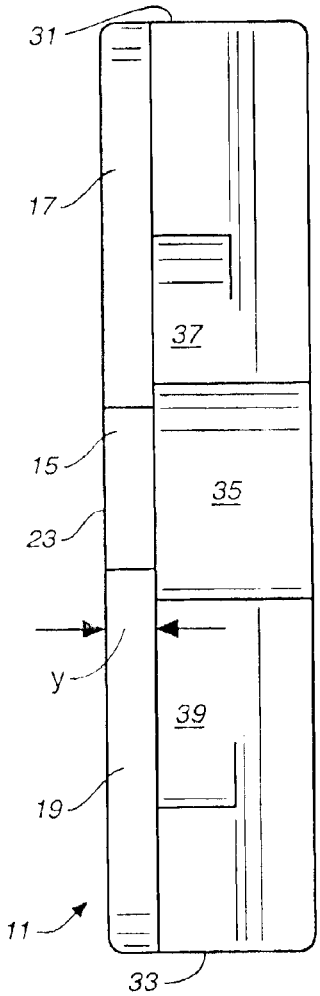
FIG. 7 is a bottom view of the apparatus of FIG. 1.

Mass relief of the club head is achieved by milling regions behind a front face 23 (FIG. 3) of the club 11 and below the top surface 21 (FIG. 7). Mass behind a rear surface 27 (FIG. 5), parallel to face 23, is removed upwardly to within a few millimeters of the top surface 21 of the club 11 in some portions. In addition to the sole 13, the mass relieved region includes a cavity 29 (FIG. 2), and heel and toe regions 31 and 33 on either side of the cavity. The cavity 29 includes a center region 35 and left and right side regions 37 and 39. The left side region 37 may be smaller than the right side region 39. Also, the center region 35 has a greater amount of mass relief towards an upper portion of the cavity 29 than either of the side regions 37 and 39. Heel and toe regions 31 and 33 have less mass relief than the central cavity 29. The mass relief is created by milling an aluminum block, but could also be made by casting or molding.

As described in U.S. Pat. No. 6,383,089, which is hereby incorporated reference, the effect of removing mass is to raise the center of gravity of the club 11. This allows the center of gravity of the club to be more inline with the center of the golf ball, the outline 25 of which is seen in FIG. 3, in order to avoid significant lofting on medium to long-range putts.

Referring back to FIG. 1, it is seen that the club has been tilted forwardly, revealing the three dimensional contours of the mass relieved regions. It is seen that heel and toe regions 31 and 33 are stepped and that mass relief does not extend all the way to the edges of the club 11, but leaves a significant amount of mass or ballast regions at the heel and toe regions. Added mass at the extremities of the club head add inertia against twisting forces.

In FIG. 7, a bottom view, club face 23 may be seen to have uniform thickness on either side and a lesser thickness in the center cavity 35 between heel region 31 and toe region 33. The mass relieved regions of cavity 29 represent more than 50% of the volume of the block from which the club head 11 is made. The sloping walls of the heel and toe regions 31 and 33 provide additional mass relief. The upper surface 21 (FIG. 4) of the club is kept intact, being a rectangular surface, but regions below the top surface 21 are mass relieved, with a gradient, i.e. more mass is relieved toward the lower surface or sole of the club. This tends to raise the center of gravity of the club with an inverted mass relief profile. The club face has a lateral axis of symmetry 61 and a vertical axis of symmetry 63 (FIG. 3). The raised center of gravity of the club is approximated by position 65, which is intended to correspond to geometric center of ball 25.

With reference to FIG. 4, the top surface 21 may be seen to have a center surface 41, which is flat and side surfaces 43 and 45. Side surfaces 43 and 45 slope symmetrically, downwardly away from the center surface 41. The flat center surface 41 and downwardly angled surfaces 43 and 45 may correspond in length and angle to the lower sole 13. In other words, the length of the center surface 41 and downwardly angled surfaces 43 and 45 is the same as the length of the central flat surface 15 and upwardly angled surfaces 17 and 19 of the sole 13, respectively, and the amount that the upwardly angled surfaces 17 and 19 are angled with respect to the central flat surface 15 is the same as the amount that the downwardly angled surfaces are angled with respect to the top center surface 41.

Figure 5:
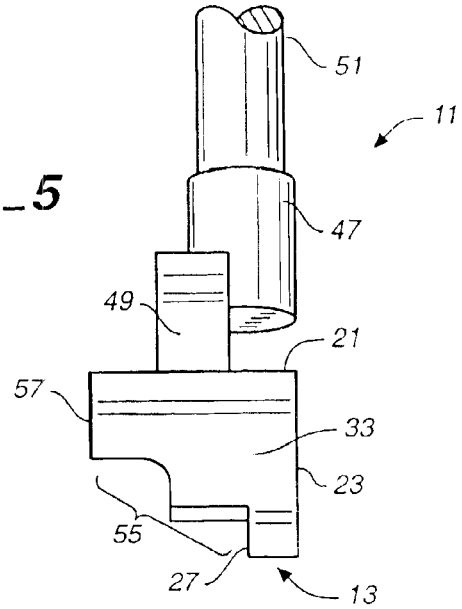
FIG. 5 is a right side view of the apparatus of FIG. 1.
Figure 6A:
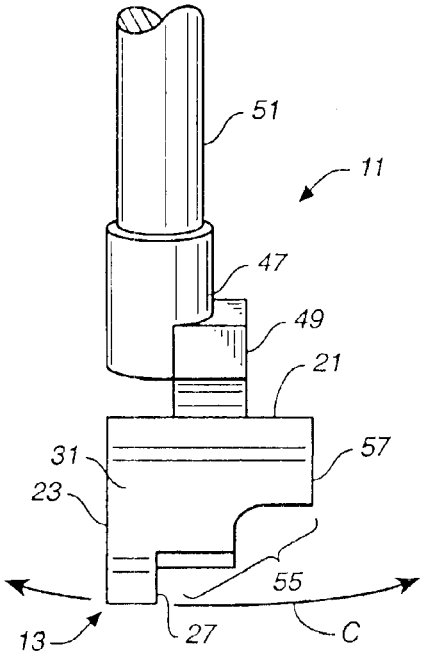
FIG. 6A is a left side view of the apparatus of FIG. 1.

With reference to FIGS. 5 and 6, the thickness of the sole 13 may be seen in proportion to the overall thickness of the club 11. Also, the stepped nature of the heel 31 and toe 33 may be seen. Club head 11 is connected to shaft 51 which may be gripped by a golfer. The shaft 51 is secured in a hosel 47, serving as a socket for the shaft. The hosel 47 is part of a hosel arm 49 which is secured to the upper surface 21 of the club head 11. Hosel 47 angles upwardly from hosel arm 49 and accommodates the shaft in a central aperture 53 (FIG. 4).

Still referring to FIGS. 5 and 6, the contour of the mass relief for both the heel 31 and toe 33 may be seen. The profiles are identical and may be characterized as stepped. The club head profile is a block metal with top surface 21 having generally rectangular edges. The front face 23 extends from a forward edge of the top surface 21 to the sole 13. Stepped region 55 of the cross section joins sole 13 to an upper rear surface 57. A lower rear surface 27 may be parallel to a front surface or face 23 of the club head 11 (FIG. 3).

Figure 6B:
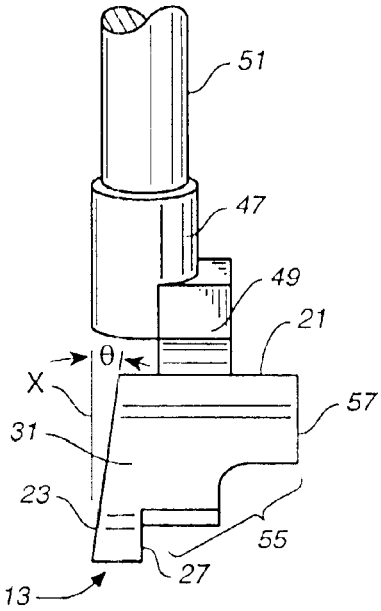
FIG. 6B is a left side view of a modified putter of the present invention with a club face slightly inclined from a vertical.

In FIG. 6B, club face 23 is seen to have an optional tilt angle theta θ, relative to vertical X of a few degrees, that is for example, less than 5 degrees. Such an angle will provide a modest amount of loft while still providing hard contact with a golf ball.

In use, the user rests the flat central surface 15 of the club head 11 (FIG. 3) on the ground (not shown) achieving a parallel or substantially parallel positioning of the club head 11 with respect to a ground surface g, and pulls the club head upwardly from the ground surface g maintaining the parallel position of the club head 11 with respect to the ground surface before putting with for example, a pendulum-like motion (as seen by arrow C in FIG. 6A) or by some other desired motion to achieve correct alignment of the club with respect to the ground. The flat central surface 15 of the club provides a narrow ground alignment zone. The user is aware that the club is within the narrow ground alignment zone, when the club head 11 is placed upon the ground surface g such that the flat central surface 15 rests upon the ground surface and/or the club head does not pivot. If either of the upwardly angled portions 17 and 19 is resting on the ground surface, the club head will pivot. This is an indication to the user that the club head 11 is not properly aligned within the ground alignment zone.

Referring to FIG. 3, the raised center of gravity 65 of the club head 11 may be referred to as the "sweet spot" and is disposed on a portion of the front face 23 of the club in alignment with the central flat surface 15 of the club. Thus, the when the flat central surface 15 is aligned parallel with respect to the ground surface, as described above, the golf ball, the outline 25 of which is seen, will be tapped with the front face 23 of the club head 11 being perpendicular or substantially perpendicular relative to the ground. This imparts to the golf ball a forward rolling motion, without topspin. The lower sole 13 is advantageous in that it assists a user in club alignment for successful putting without getting in the way of the put.

Figure 8:
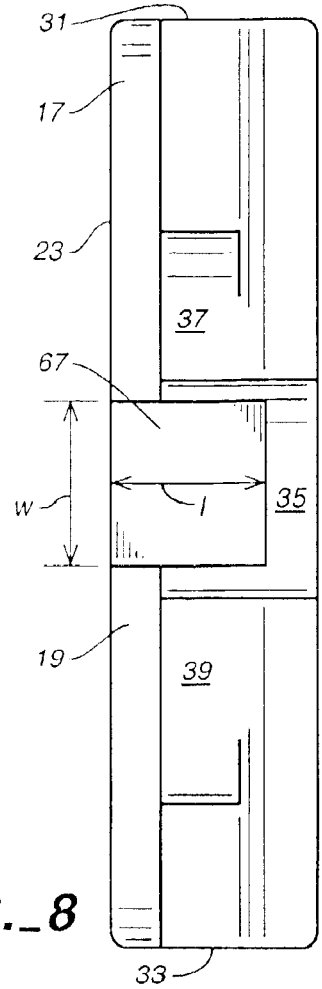
FIG. 8 is a bottom view of an alternative embodiment of the apparatus of FIG. 1.
Figure 9:
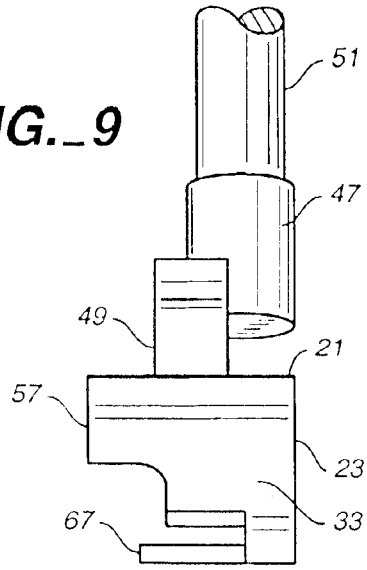
FIG. 9 is a right side view of the apparatus of FIG. 8.

With reference to FIGS. 8 and 9, in another embodiment of the invention, a central surface of the sole may be cantilevered rearwardly from the sole, in the form of a flat tongue-like projection 67 extending away from the front face 23 of the club, as seen in FIGS. 8 and 9. The tongue-like projection 67 assists the user in achieving a proper putting stance. The user is aware that he is in a proper putting stance when the flat central extending tongue 67 is parallel to the ground surface. When the user contacts the ground surface with the bottom of the flat portion 67 of the sole, the club will not pivot. Before putting, the user lifts the club and maintains the parallel positioning. The tongue-like projection may extend out from the sole and away from the front face 23 in the amount of, for example, a few millimeters to about 2.5 cm in length, but typically not past the upper surface 21. The width w of the flat central tongue-like projection 67 corresponds to the length of the flat central portion 15 of the sole 13, however, the length 1 of the tongue-like projection is greater than the width y of the side 13 (FIG. 7).

Further, the smaller size of the sole 13, due to the mass relief, reduces the amount of resonance of the club that the user typically experiences in his hands when the club makes contact with the ball. Thus, the lower sole 13, results in more control and less vibration during putting compared to the putters of the prior art, such as those having a curved sole.

What is claimed is:

1. A head for a golf club comprising:

a metal head having a block shape with a top surface, a sole opposite the top surface, a face transverse to the top surface, a mass relieved region behind the face and below the top surface relieving the sale entirely except for a flat central surface and a pair of upwardly angled surfaces on either side of said flat central surface, said angled surfaces being angled with respect to said flat central surface, whereby the flat central surface provides a narrow ground alignment zone.

2. The golf club head of claim 1 wherein said flat central surface has a portion cantilevered back from said sole and away from said face.

3. The golf club head of claim 1 wherein said angled surfaces are equally angled with respect to said flat central surface.

4. The golf club head of claim 1 wherein said angled surfaces are the same length.

5. The golf club head of claim 1 wherein said angled surfaces are about 3 cm in length.

6. The golf club head of claim 1 wherein said angled surfaces are angled at about 15 degrees with respect to said flat central surface.

7. The golf club head of claim 1 wherein said top surface is wider than said lower sole.

8. The golf club head of claim 1 wherein said lower sole is about 3 mm wide.

9. The golf club head of claim 1 wherein said lower sole ranges from 1–10 mm in width.

10. The golf club head of claim 1 wherein said flat central surface is about 2 cm in length.

11. The golf club head of claim 1 wherein said top surface is adapted for connection to a shaft.

12. The golf club head of claim 1 wherein said top surface includes a flat center surface and a pair of downwardly angled surfaces on either side of said flat center surface, said flat center surface and angled surfaces corresponding in length and angle to said lower sole region.

13. The golf club head of claim 1 wherein said face is angled relative to a vertical axis.

14. The golf club head of claim 13 wherein said angle is less than 5 degrees.

15. The golf club head of claim 1 further comprising laterally opposed heel and toe regions.

16. The golf club head of claim 15 wherein said heel and toe regions are partially relieved, leaving ballast regions having greater cross-sectional mass at the heel and toe regions than at regions between the heel and toe regions.

17. A golf club comprising:

a shaft terminating in a hosel having a hosel arm; and a metal head having a block shape with a top surface, a sole opposite the top surface, a face transverse to the top surface, a mass relieved region behind the face and below the top surface relieving the sole entirely except for a flat central surface, and a pair of upwardly angled surfaces on either side of said flat central surface, said angled surfaces being angled with respect to said flat central surface whereby said flat central surface provides a narrow ground alignment zone.

18. The golf club head of claim 17 wherein said flat central surface has a portion cantilevered back from said sole and away from said face.

19. The golf club head of claim 18 wherein said cantilevered central surface is about 2.5 cm in length.

* * * * *